United States Patent [19]

Ida

[11] Patent Number: 4,962,361

[45] Date of Patent: Oct. 9, 1990

[54] IGNITION COIL FOR ENGINE

[75] Inventor: Yasuhiko Ida, Saitama, Japan

[73] Assignee: Honda Giken Kogyo Kabushiki Kaisha, Tokyo, Japan

[21] Appl. No.: 399,811

[22] Filed: Aug. 29, 1989

[51] Int. Cl.[5] ..... H01F 27/04; H01F 15/10; H01F 27/26

[52] U.S. Cl. ..... 336/90; 336/107; 336/192; 336/210; 336/216; 439/395

[58] Field of Search ..... 439/395, 396; 336/192, 336/105, 107, 210, 212, 216, 198, 208, 90; 310/71; 123/634

[56] References Cited

U.S. PATENT DOCUMENTS 3,854,114 12/1974 Kloth et al. ..... 439/395 X 4,672,348 6/1987 Duve ..... 336/192

*Primary Examiner*—Thomas J. Kozma

*Attorney, Agent, or Firm*—Lyon & Lyon

[57] ABSTRACT

There is disclosed an ignition coil for an engine including a terminal coupler formed integrally with a coil bobbon, a connecting terminal rotatably mounted in said terminal coupler, so that it is electrically connected to a terminal arranged in said terminal coupler and having a cut groove formed therein, said cut groove having a groove width which is slightly narrower at its inner side than that of a coil wire, and a holder for holding a terminal end of a coil pulled out of said coil bobbin, said holder being arranged on the side of said terminal coupler, in which said connecting terminal is rotated, whereby the terminal end of the coil held in the cut groove of said holder becomes positively gripped into the cut groove of said holder, to form an electrical connection between said connecting terminal and the terminal and of said coil.

2 Claims, 6 Drawing Sheets

IGNITION COIL FOR ENGINE

BACKGROUND OF THE INVENTION

1. Field of the Invention

The present invention relates to an ignition coil for an engine.

2. Description of the Prior Arts

Heretofore, it has been a conventional method of manufacturing an ignition coil for an engine by winding a primary coil around a coil bobbin of a primary side, attaching a terminal coupler to the coil bobbin, pulling coil wire of the primary coil out of the coil bobbin at a leading end and a trailing and of said primary coil and then connecting each of the coil wires at the leading and trailing ends of the primary coil to each terminal of the coupler by soldering process.

According to such conventional method, it is required to connect the coil bobbin and the terminal coupler, which are prepared as separate parts, and it is also required to take steps of stripping or covering of the coil wire, winding the stripped coil wire around the terminal of the coupler and then soldering the coil wire to the terminal. This conventional manufacturing method is disadvantageous in that it requires a large number of parts and it is low in its working efficiency.

On the other hand, in case of an ignition coil for an engine of the type where a C-type core part is assembled in a coil case which is arranged to assemble a coil unit therein so that a side of said C-type core part is passed into said coil case, and an I-type core part is pressed into engagement with an opening end of said C-type core part to form a construction in which the core consisting of the C-type core part and the I-type core part is integrally assembled in the coil case, it is necessary to provide a clearance between the coil case and the I-type core part which is pressed into engagement with the C-type core, in order to allow the pressure engagement of the I-type core part to the C-type core part.

Owing to the existance of such clearance, the ignition coil of this type tends to cause a play between the core and the coil case after assembling.

In order to avoid such disadvantage, it has been heretofore necessary to fill the clearance between the coil case and the core, after assembling the core to the coil case, with an adhesive material to fixedly connect the core to the coil case. However, such use of the adhesive material requires the core adhering step, so that the working efficiency at the time of manufacturing ignition coils is lowered.

SUMMARY OF THE INVENTION

It is a general object of the present invention to eliminate the above-mentioned defects in the prior arts.

It is a specific object of the present invention to provide an ignition coil for an engine wherein a coil bobbin at a primary side and a terminal coupler are constructed in an integral part, in order to reduce a number of parts required to form the ignition coil, and a coil wire pulled out of the coil bobbin and a terminal of the coupler can be easily connected, without requiring soldering or electric welding process.

It is another object of the present invention to provide an ignition coil for an engine which is so constructed that a core can be fixedly assembled to a coil case, by only pressing an I-type core into engagement with a C-type core, and no play can be caused by the clearance a mentioned above.

In accordance with the present invention, there is provided an ignition coil for an engine including a coil unit consisting of a coil bobbin around which a secondary coil is wound, a coil bobbin around which a primary coil is wound and a coil unit, and a coil case having an opening end into which said coil unit is assembled, in that the part of the coil case is molded with resinous material thereby forming an integrally fixed construction as a whole.

DESCRIPTION OF THE PREFERRED EMBODIMENT

Now, descriptions will be given to a preferred embodiment of the invention, with reference to the drawings.

Figure 1:
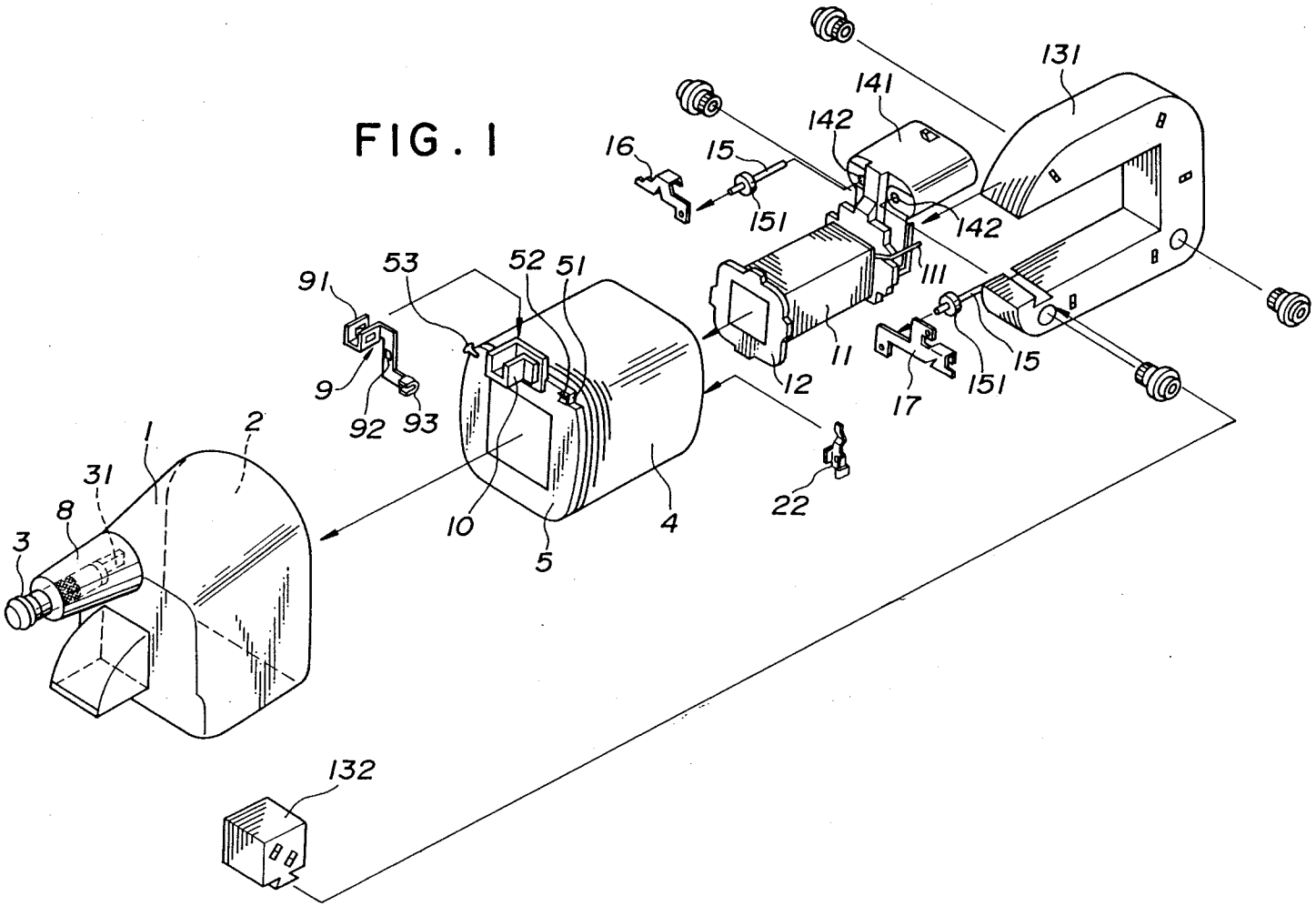
FIG. 1 is an exploded perspective view showing an ignition coil for an engine according to an embodiment of the present invention.
Figure 2:
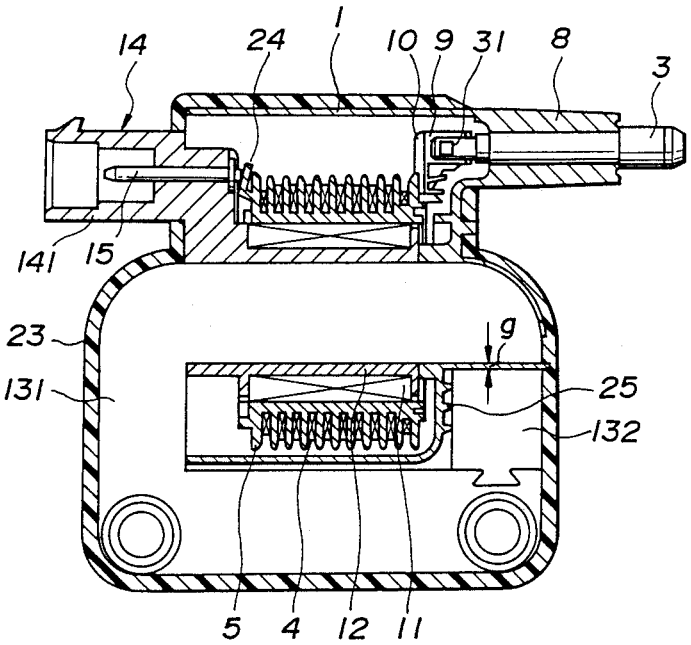
FIG. 2 is a sectional view of the ignition coil shown in FIG. 1.

The ignition coil for the engine according to the present invention, as shown in FIGS. 1 and 2, includes a coil unit consisting of a coil bobbin 5 having a secondary coil 4 wound therearound, a coil bobbin 12 having a primary coil 11 wound therearound and a magnetic core 131 and 132. The ignition coil further includes a coil case 1 having an opened end 2. Said coil unit is assembled into the coil case 1 and the part of the coil case 1 is molded by resinous material 23, so that they form a wholly fixed integral structure.

The coil unit is so constructed that the coil bobbin 12 at the primary side is inserted into a hollow shaft of the coil bobbin 5 at the secondary side in coaxial relation with each other, and furthermore, one side of the core 131 is inserted into a hollow shaft of the coil bobbin 12 at the primary side.

The coil case 1 has a hollow shaft (not shown) which is formed at the central part of the inside thereof and projects in integral relation with the case. The coil bobbin 12 of the primary side is fitted outside of said hollow shaft and the core 131 is arranged in the coil case 1 so that one side of the core passes through the coil case.

The core of the ignition coil consists of a combination of a C-type core part 131 and a small I-type core part 132, and the core part 132 is pressed into fitting engagement with one end of the core 131 at the outside of the coil case 1, as shown in FIG. 2, thereby forming a closed magnetic circuit.

In order to allow pressed engagement of the I-type core portion 132 into the C-type core portion 131, a clearance C of the order of 1 mm is provided between the coil case 1 and the I-type core portion 132 which is to be pressed into engagement with the C-type core portion 131.

In this case, a case member of the coil case 1 which has a thickness of the order of 1 mm and consists of non-magnetic material is interposed between the forward end of the core part 131 mounted in the coil case 1 and the core part 132, whereby a gap is formed therebetween. Without such gap, the hysteresis caused by the core 131 and 132 is increased to such extent that the conversion efficiency of the coil is lowered and the igniting characteristic of the engine is determined.

The above construction may be so modified that the case member of the coil case 1 consisting of non-magnetic material is not interposed between the forward end of the core portion 131 mounted into the coil case nd the core portion 132, which the core portion 132 is fitted into one end of the core portion 131 so that an air gap of the order of 1 mm is formed between the forward end of the core portion 131 and the core portion 132 and said air gap is filled with a resinous material at the time of molding.

The primary coil bobbin 12 has a low-voltage terminal coupler 14 which is formed on said primary coil bobbin, and which is arranged to project outwardly when the primary coil bobbin 12 is combined into the secondary coil bobbin 5.

The low-voltage terminal coupler 14 is so constructed that the terminal pins 15 having stoppers 151, respectively, are inserted through two holes 142 formed at a rear wall of a coupler case 141, as shown in FIG. 1, so that the rear ends thereof appear rearwardly of the coupler case 141.

As shown in FIG. 2, when the primary coil bobbin 12 is assembled into the secondary coil bobbin 5, the rear ends of the respective terminal pins 15 inserted into the coupler case 141 are pressed toward the coupler case 141 under the action of a pin retainer 24 having elastic preparty which is formed on a flange portion of the secondary coil bobbin 5.

The terminal pin 15 is not always of a rod type but it may be of plate type.

According to the present invention, the ignition coil for the engine of the type as described above, as shown in FIGS. 3(*a*), 3(*b*) and 3(*c*), includes connecting terminals 16 and 17 which are rotatably attached to terminal pins 15 arranged in the coupler case 141 so that they are electrically connected with each other, and a holder 18 is mounted on the coupler case 141. Said holder 18 acts to hold each of coil wires 1, 1 which is pulled out of the primary coil bobbin 12 at leading end and trailing end of winding of the primary coil 11. A cut groove 19 which has a groove width at its inner side slightly narrower than a diameter of the coil wire 111 is formed in each of the connecting terminals 18 and 17. These connecting terminals are so arranged that each coil wire 111 held in the groove of the holder 18 becomes bited by the cut groove 19 by rotating each of the connecting terminals 18 and 17, thereby forming electrical connection between each of the connecting terminals 18 and 17 and each of the coil wires 111.

The connection of the respective terminal pins 15 and the coil wire 111 by means of the connecting terminal members 18 and 17 is effected in the following manner.

Figure 3:
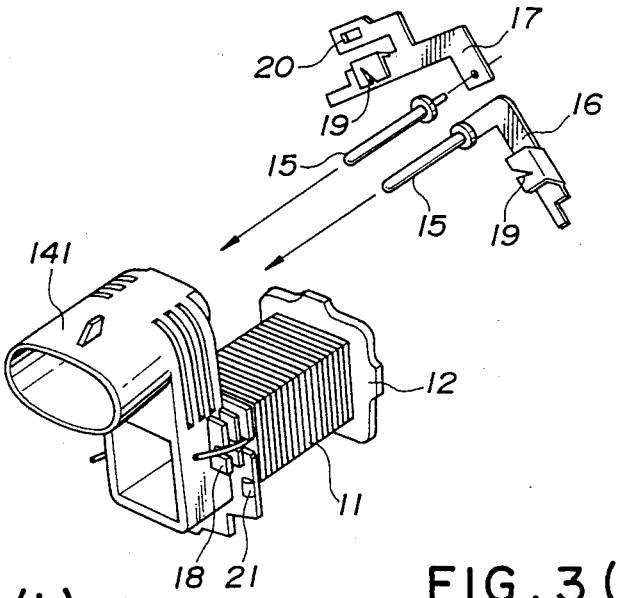
FIGS. 3(*a*), 3(*b*) and 3(*c*) are perspective views of a part of a primary coil bobbin, showing successive steps of connecting a low-voltage terminal pin to terminal of a primary coil effected by a connecting terminal member in the same embodiment.
Figure 3:
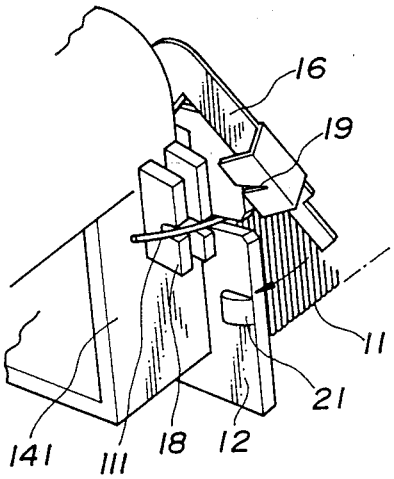
Figure 3:
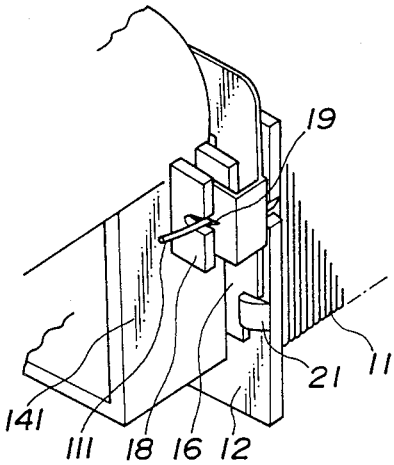

Firstly, the connecting terminal members 18 and 17 are attached to the ends of the respective terminal pins 15 by caulking (which provides electric connection between then) as shown in FIG. 3(*a*). The respective terminal pins 15 are mounted in the coupler case 141.

Then, as shown in FIGS. 3(*b*) and 3(*c*). the connecting terminal member 18(17) is rotated, whereby the coil wire 111 held in the groove of the holder 18 of the coupler 14 becomes bited by a cut groove 19 formed on the connecting terminal member 18 or 17, so that they are electrically connected together.

Figure 4:
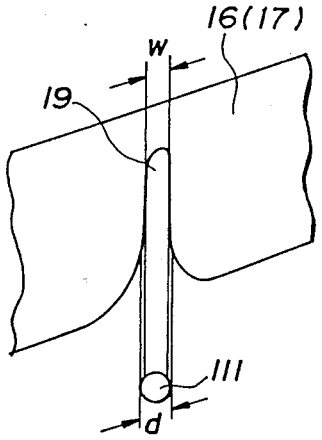
FIG. 4 shows a cut groove formed in a connecting terminal.

The cut groove 19 has a width which is slightly narrower than a diameter of the coil wire 11 at its inner side, as shown in FIG. 4, and said narrower side of said cut groove bites the coil wire 111, so that an insulating convering of the coil wire 111 is broken thereby and the electrical conduction is produced therebetween.

A stopper 21 is formed on the coil bobbin 12, and the forward end of the connecting terminal member 16(17). which has bited the coil wire 111 at the cut groove 19, comes into engagement with the stopper 21, thereby locking the connecting terminal member 16(17).

As described above, according to the present invention, the electrical connection of the terminal pin 15 with the coil wire 111 can be made in easy and reliable manner, only by rotating the respective connecting terminals 16 and 17 to cause the coil wires to become bited by the cut groove 19.

Accordingly, it is not required to take steps of stripping a covering of a coil wire 111 and then connecting the stripped portion to a terminal portion by winding said portion around the terminal portion and applying soldering or welding thereto, as in the conventional manufacturing process. Thus, the number of steps required to connect the terminal pin 15 and the coil wire can be considerably reduced.

Figure 5:
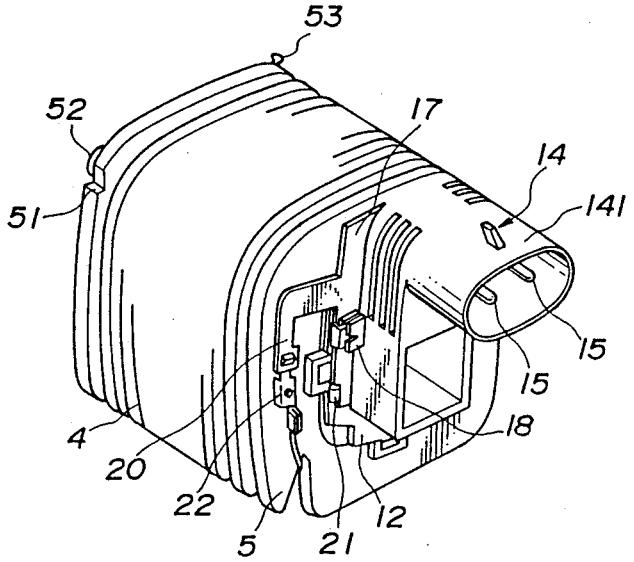
FIG. 5 is a perspective view showing a part of combination of a primary coil bobbin and a secondary coil bobbin, in the same embodiment.

A common connecting terminal portion 20 for the primary coil 11 and the secondary coil 4 is integrally formed on one connecting terminal 17. The common connecting terminal 20 is arranged to come into contact with a coil terminal 22 attached to the coil bobbin 5, when the primary coil bobbin 12 is assembled with the secondary coil bobbin 5, as shown in FIG. 5. The contacting portions are connected together by soldering or welding.

Figure 6:
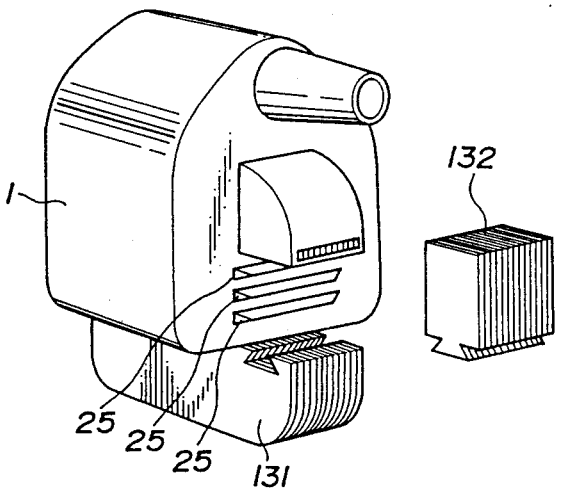
FIG. 6(*a*) and 6(*b*) are perspective views of a coil case and a core part, showing steps of pressing an I-type core part into engagement with a C-type core part mounted in a coil case.
Figure 6:
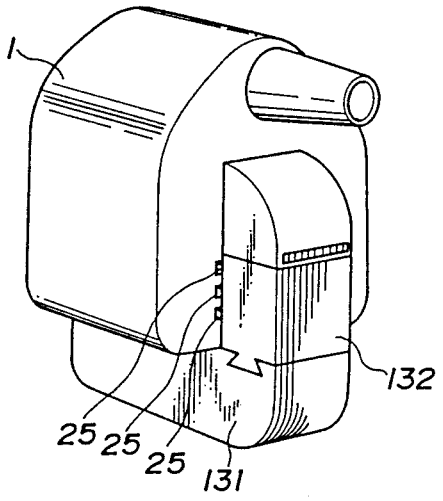
Figure 7:
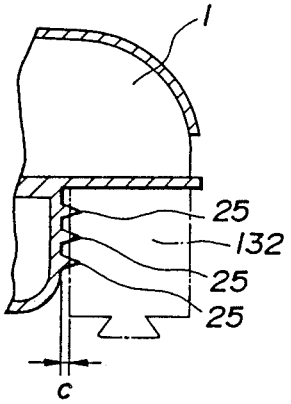
FIG. 7 is a sectional view of a rib part disposed between a coil case and an I-type core part.

In the ignition coil for the engine according to the present invention, ribs 25 are formed, as shown in FIGS. 6(*a*) and 6(*b*). on the outside of the coil case 1 in opposite relation to the I-type core portion 132 so that these ribs project slightly beyond the clearance c (see. FIG. 7); and the I-type core portion 132 is arranged to be pressed into engagement with the C-type core portion 131 while crushing the forward ends of said ribs 25.

In the embodiment shown in FIG. 7, a plurality of ribs 25 are formed in stepwise in the direction of pressing the I-type core portion 132.

Accordingly, the I-type core portion 132 in the integrally assembled core becomes supported by the ribs 25 at the part of the clearance c, only by pressing the I-type core portion into the C-type core portion, and the coil case 1 is sandwiched between the core portions, so that the core becomes fixedly assembled to the coil case 1.

The rib 25 is integrally formed on the coil case 1 made of synthetic resinous material, in a pointed triangular shape in section, so that its pointed end portion is crushed when the I-type core portion 132 is pressed into the C-type core portion and thus the I-type core portion can be easily pressed into the C-type core portion.

In the construction as shown in FIG. 1, a high-voltage terminal pin 3 is inserted into a boss portion 8 of the coil case 1 and fixed thereto, so that a plug portion 31 projecting from a rear end of the high-voltage terminal pin 3 projects into the inside of the coil case.

A secondary coil output portion g is attached to a flange portion of the coil bobbin 5 around which the secondary coil 4 is wound, in opposite relation to the plug 31 of the high-voltage terminal pin 3. The secondary coil output terminal g is formed with a socket portion 91 having elastic property which is arranged to cooperate with the plug 31 of the above-mentioned high-voltage terminal pin 3. When the secondary coil bobbin 5 is inserted into the coil case 1, as shown in FIG. 2, the plug 31 of the high voltage terminal pin 3 is inserted into the socket portion 91 of the secondary coil output terminal g, thereby forming an electrical connection therebetween.

Figure 8:
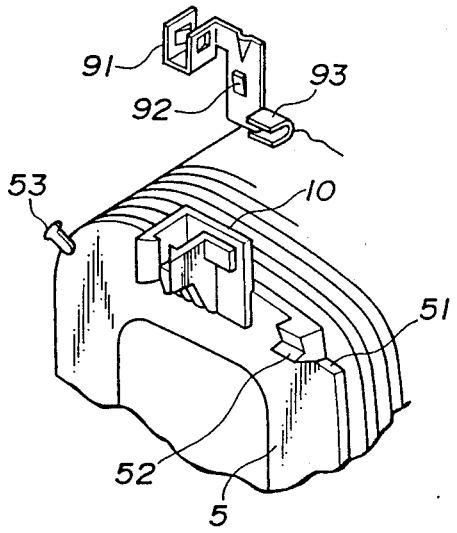
FIGS. 8(*a*), 8(*b*) and 8(*c*) are perspective views of a secondary coil bobbin part of the ignition coil of the same embodiment, showing successive steps of attaching a secondary coil output terminal member to the coil.
Figure 8:
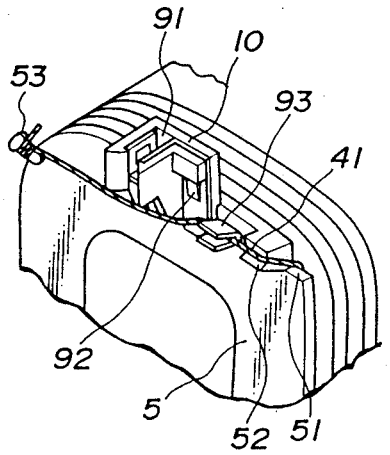
Figure 8:
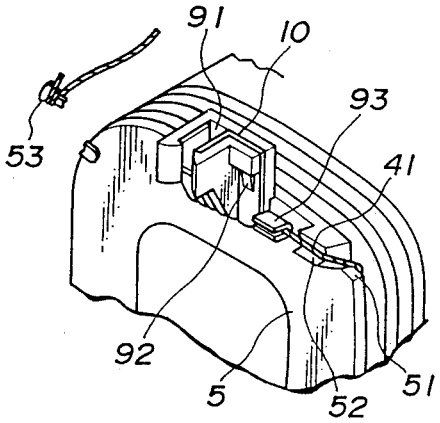

The secondary coil output terminal 9 is arranged to be inserted into a holder 10 arranged on a flange portion at one end of the coil bobbin 5 and held in the holder 10 by causing a raised portion 92 formed on the side of the terminal member g to come into engagement with a stepped portion formed on the side of the holder 10, as shown in FIGS. 8(*a*) and 8(*b*).

The secondary coil output terminal g has a connecting portion 93 integrally formed therewith. The coil wire 41 is pulled out of the coil bobbin 5 at the end of winding of the secondary coil 4 wound around said coil bobbin 5 and then connected to said connecting portion 93.

The secondary coil wire 41 is connected to the connecting portion 93 in the manner as described below.

Firstly, one end of the coil wire 41 pulled out of the coil bobbin 5 through a cut groove 51 formed in the flange portion of the coil bobbin 5, as shown in FIG. 8(*b*). is guided by a guide projection 52 and is passed through a center of a U-shaped groove formed on the connecting portion 93 of the secondary coil output terminal 93 of the secondary coil output terminal member. The coil wire is wound around a projection 53 formed on the coil bobbin 5 to temporarily fix the terminal end of the coil wire, as shown in FIG. 8(*b*).

Then, the coil wire 41 is connected to the connecting portion, by fusing connection, while crushing the connecting portion 93 of the secondary coil output terminal member 93, as shown is FIG. 3(*c*), and useless portions of the secondary coil wire 41 are cut and removed, together with the projection 53 of the coil bobbin 5.

It will be understood that the present invention provides an ignition coil for an engine which includes a coil bobbin, a terminal coupler integrally formed on the coil bobbin, a connecting terminal arranged to be rotatably attached and electrically connected with a terminal of said terminal coupler and a holder arranged on the side of the terminal coupler and having a groove for holding a coil wire pulled out of the coil bobbin. in which an electric connection can be formed between the connecting terminal and the coil wire by rotating the connecting terminal so that the coil wire held by the groove of the holder is caused to be bited by the cut groove having a groove width at its inner side slightly smaller than a diameter of the coil wire. Such construction of the ignition coil has such superior advantages that the primary coil bobbin and the terminal coupler can be formed as an integral part, whereby the number of parts required to form the ignition coil can be reduced and, furthermore, the connection between the coil wire pulled out of the coil bobbin and the terminal of the terminal coupler can be made in easy manner, without requiring the soldering or electric welding process.

The present invention further provides an ignition coil for an engine which includes a coil case and a core consisting of a C-type core portion and an I-type core portion, said C-type core portion being arranged to be inserted at one side into the inside of the coil case, and said I-type core portion being arranged to be pressed into engagement with an opened end of the C-type core portion at the outside of the coil case, in which a rib is formed on and projects from the outside of the coil case opposed to the I-type core portion and the I-type core portion is pressed into engagement with the C-type core portion, while crushing said rib. Such construction of the ignition coil has such superior advantages that the core consisting of the combination of the C-type core portion and the I-type core portion can be fixedly assembled in the coil case, without causing any play therebetween owing to the existence of the clearance formed between the coil case and the I-type core portion which enables pressure engagement of the C-type core portion with the I-type core portion only by pressing the 1-type core portion into the C-type core portion and that the adhering process of the core to the coil case after assembling, which has been heretofore required, is not required, working efficiency at the time of manufacturing the ignition coil is improved, and the ignition coil can be effectively adapted to automatic assembling process.

I claim:

1. An ignition coil for an engine, comprising:

a coil bobbin;

a terminal coupler integrally formed on said coil bobbin;

a connecting terminal rotatably attached so that it can be electrically connected to a terminal arranged in said terminal coupler, said connecting terminal having a cut groove having a groove width at its inner side slightly smaller than a diameter of wire forming a coil on said bobbin and a holder provided at the side of said terminal coupler to hold a terminal end of said coil pulled out of said coil bobbin;

said connecting terminal being arranged to be rotated to cause the terminal end of the coil held in the groove of said holder to become bited by said cut groove, thereby forming an electric connection between said connecting terminal and the terminal end of said coil.

2. An ignition coil for an engine, according to claim 1, which includes a core consisting of a combination of a C-type core portion and an I-type core portion, and a coil case into which said core is assembled, in which said coil case has a rib formed outside thereof and projecting therefrom, and said C-type core portion is arranged to be inserted into the inside of said coil case, with one side of said C-type core being passed into the coil case, while said I-type core portion is arranged to be pressed into an opened and of said C-type core portion at the outside of said coil case, while crushing said rib.

* * * * *

UNITED STATES PATENT AND TRADEMARK OFFICE

CERTIFICATE OF CORRECTION

PATENT NO. : 4,962,361

DATED : October 9, 1990

INVENTOR(S) : Yasuhiko Ida

It is certified that error appears in the above-identified patent and that said Letters Patent is hereby corrected as shown below:

Title Page, [73]

Change the name "Honda Giken Kogyo Kabushiki Kaisha, Tokyo Japan" to read -- Toyo Denso Kabushiki Kaisha, Tokyo, Japan--.

Signed and Sealed this

Twenty-ninth Day of December, 1992

*Attest:*

DOUGLAS B. COMER

*Attesting Officer*

*Acting Commissioner of Patents and Trademarks*